United States Patent [19]

Brink et al.

[11] 3,982,645

[45] Sept. 28, 1976

[54] CONTAINER HANDLING ATTACHMENT

[75] Inventors: Thomas E. Brink; Charles R. Chelin; Norman D. Thompson, all of Dallas, Oreg.

[73] Assignee: Towmotor Corporation, Mentor, Ohio

[22] Filed: Mar. 27, 1975

[21] Appl. No.: 562,610

[52] U.S. Cl. ..... 214/620; 214/653

[51] Int. Cl.[2] ..... B66F 9/18

[58] Field of Search ..... 214/620, 621, 650 R, 214/651, 652, 653, 654

[56] References Cited

UNITED STATES PATENTS

| | | | |
|---|---|---|---|
| 2,620,937 | 12/1952 | Halloran | 214/653 |
| 2,693,289 | 11/1954 | Winski | 214/653 |
| 2,698,107 | 12/1954 | Ericson | 214/654 X |
| 2,714,463 | 8/1955 | Fraser | 214/620 |
| 2,905,347 | 9/1959 | Hopfeld | 214/654 |

FOREIGN PATENTS OR APPLICATIONS

| | | | |
|---|---|---|---|
| 1,047,718 | 12/1958 | Germany | 214/651 |
| 194,073 | 1/1965 | Sweden | 214/620 |

*Primary Examiner*—L. J. Paperner
*Attorney, Agent, or Firm*—Oscar G. Pence

[57] ABSTRACT

A container handling attachment is provided for lift trucks and the like to permit such trucks to load and transport relatively large horizontally disposed cylindrical objects. The attachment includes a pair of sleeve members which are slidably received over the forks of a conventional lift mast to permit easy attachment thereto. The attachment also includes a pair of lifting lugs which are selectively positionable in underlying engagement with a pair of longitudinally spaced lifting bars provided on the object. Latching means are positionable around such lifting bars to prevent their disengagement from the lifting lugs. Bumper stops are also provided for engagement with the legs of the object to prevent rotation of the object about its longitudinal axis when it is raised from the ground.

10 Claims, 5 Drawing Figures

16
14
10
17
13
12
24
22
64
25
71
26
26
21
20
30
29
28
28
29

16
10
16
30
40
17
69
42
64
43
39
48
45
40
64
50
33
17
49
39
46
45
48
35
32
38
38
67
70
36
67

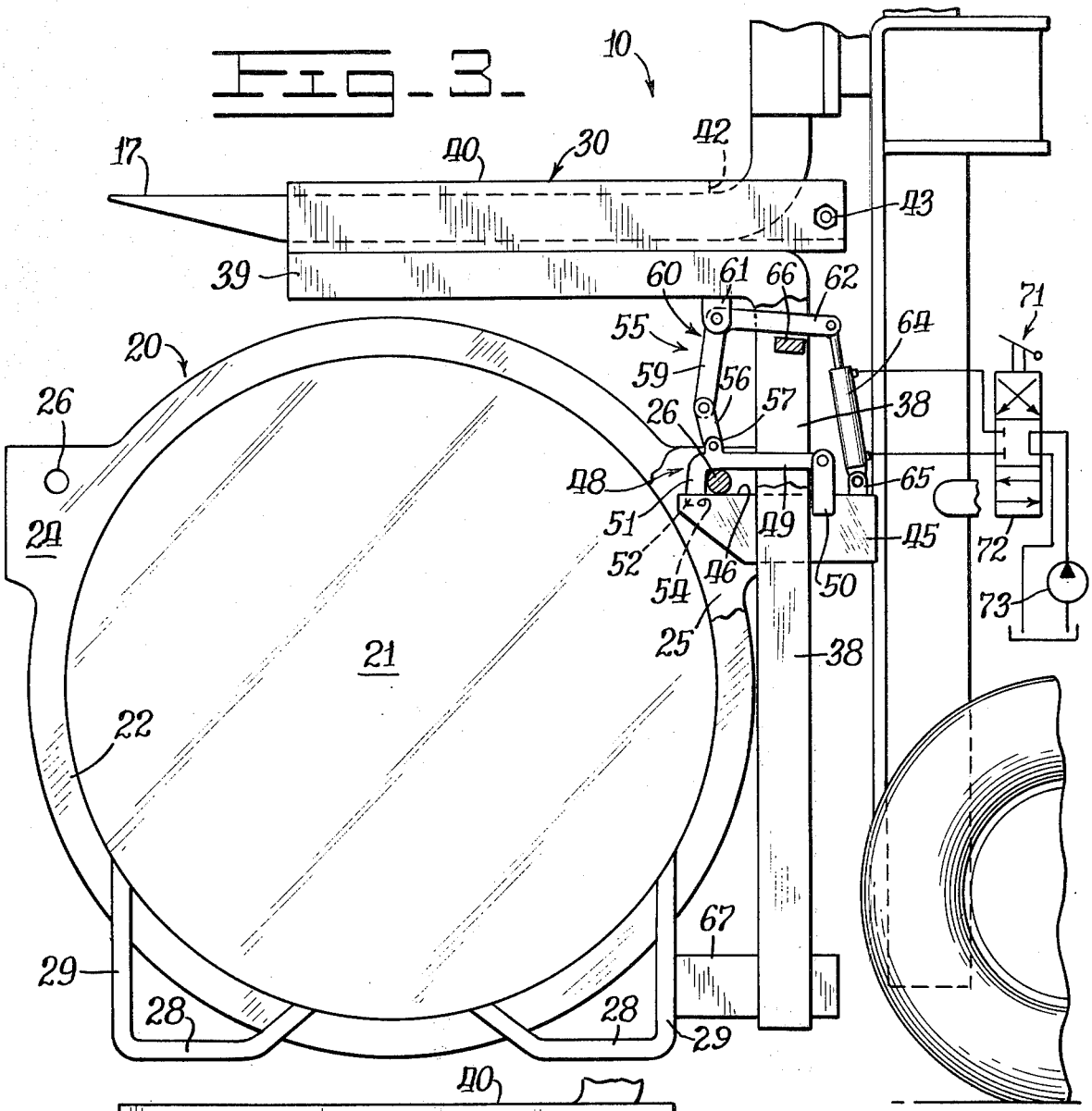
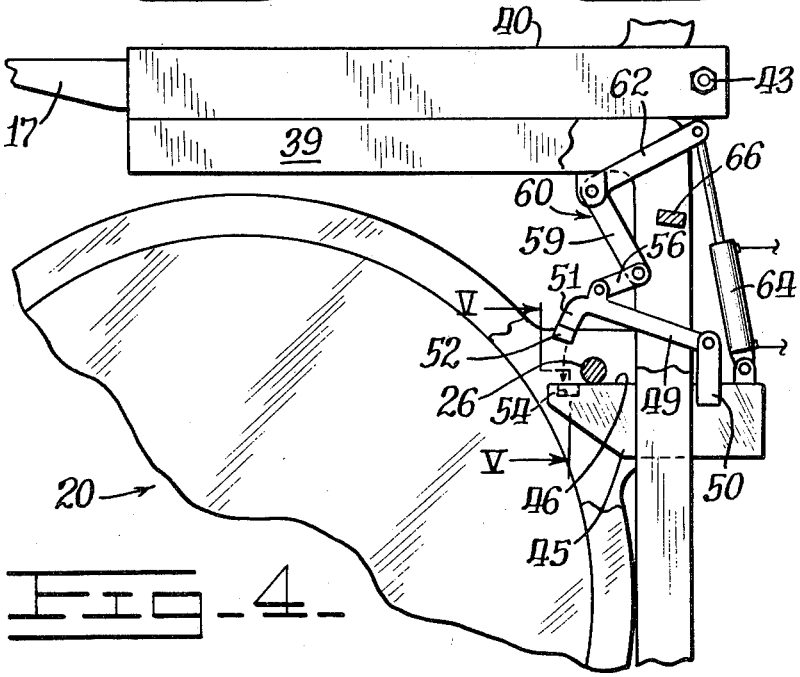
Fig. 4
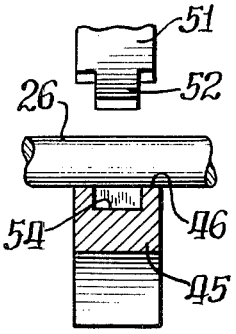
Fig. 5

CONTAINER HANDLING ATTACHMENT

BACKGROUND OF THE INVENTION

1. Field of the Invention

This invention relates to an attachment for a lift truck and more particularly to such attachment for handling relatively large horizontally disposed cylindrical objects and the like.

2. Description of the Prior Art

Manufacturers of liquid chemicals, such as tetraethyllead and the like, frequently ship their products to commercial users in relatively large horizontally disposed drum-type shipping tanks. Such tanks typically have capacities of 1,000 gallons (3,785 liters) or more with gross weights in excess of 20,000 lbs. (9,072 kg). As such tanks are normally stored in a storage area remote from an area where they are shipped from, transportation for the tanks must be provided between such areas.

In the past, when shipment has been by rail, transportation from the storage area to the shipping area or rail siding has been accomplished by the use of a flatbed truck or other similar transport vehicle and an overhead crane for loading the tank onto and off the truck. Due to the limited mobility of such cranes, two are frequently used, one at the storage area, and the other at the rail siding for removing the tank from the truck and loading it on a waiting rail car. Such type of loading operation can require up to five men which includes two crane operators, a truck driver, and two helpers for hooking and unhooking the crane cables to the tank and for aiding the crane operators to insure the proper positioning of the tank on the truck or the rail car. Such customary practice is extremely costly and time consuming due to the various pieces of equipment used and the inefficient use of manpower.

OBJECTS OF THE INVENTION

Accordingly, an object of this invention is to provide a simple and easy to handle attachment for a lift truck which enables such lift truck to pick up and carry relatively large, horizontally disposed cylindrical objects from place to place without the assistance of other pieces of equipment or personnel.

Another object of this invention is to provide a relatively inexpensive and non-complex attachment which is easily and readily connectable to and disconnectable from the forks of such lift truck and which greatly enhances the overall efficiency of handling such objects.

Another object of this invention is to provide for safer handling of such cylindrical objects by providing means on the attachment to prevent the inadvertent loss of such object during operation.

Other objects and advantages of the present invention will become more readily apparent upon reference to the accompanying drawings and following description.

BRIEF DESCRIPTION OF THE DRAWING

FIG. 3 is an enlarged side elevational view of the attachment as shown in FIG. 1, but with portions broken away to illustrate the engaged position of its latching mechanism.

FIG. 4 is a fragmentary side elevational view similar to FIG. 3, but illustrating the disengaged position of the latching mechanism.

FIG. 5 is an enlarged sectional view taken along the line V—V of FIG. 4.

DETAILED DESCRIPTION OF THE PREFERRED EMBODIMENT

Figure 1:
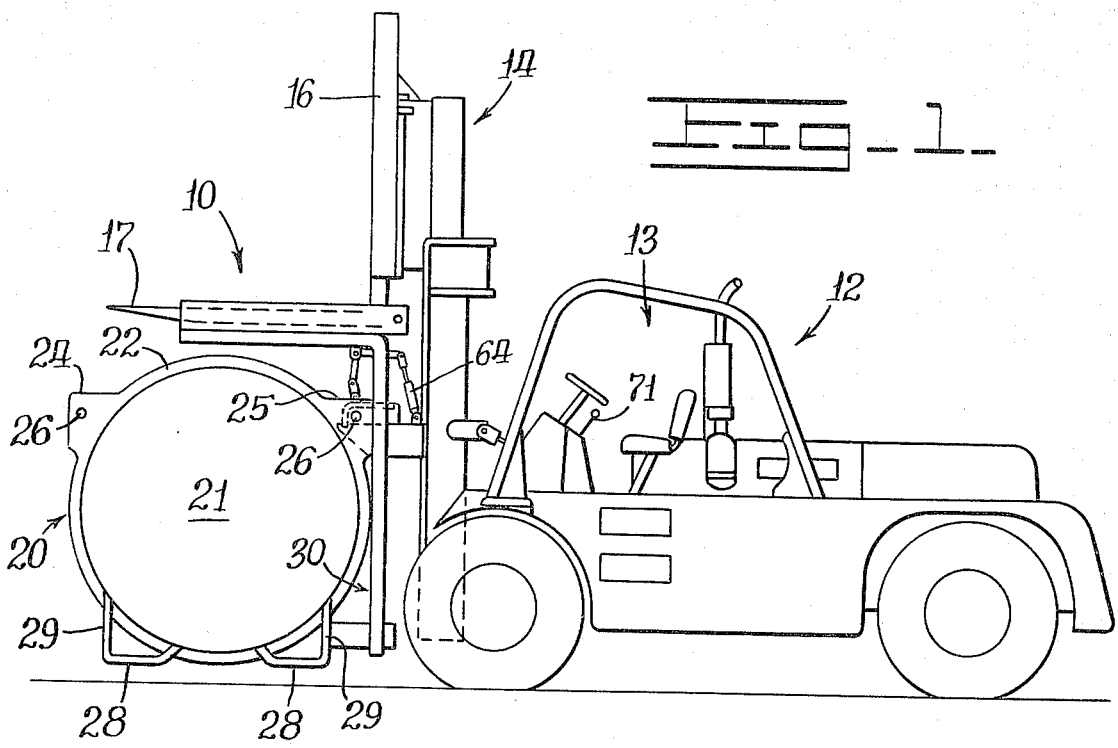
FIG. 1 is an overall lefthand side elevational view of a container handling attachment embodying the principles of the present invention mounted on a lift truck and supporting a relatively large drum-type shipping tank.

Referring more particularly to the drawings, a container handling attachment embodying the principles of the present invention is generally illustrated at 10 in FIG. 1 for use in association with a conventional lift truck 12. The lift truck includes an operator station 13 and a lift mast 14 carried at the forward end of the truck in the usual manner. The lift mast includes a vertically movable mast carriage 16 supporting a pair of forwardly extending, laterally spaced lift forks 17.

The container handling attachment 10 enables the lift truck 12 to handle a relatively large cylindrical object or drum-type shipping tank, generally illustrated at 20. In the present instance, the particular shipping tank illustrated includes a cylindrically shaped metal drum 21 which is 54 inches (1.37m) in diameter and 12 feet, 9⅝ inches (3.90m) in length and providing a capacity of 1354 gallons (5125 liters). When filled with tetraethyllead, such tank has a gross weight of 22,000 lbs. (9,997 kg). The tank is provided with a plurality of longitudinally spaced support rings, one of which is shown at 22, which are secured about the periphery of the drum 21 and arranged in relatively closely spaced pairs intermediate the opposite ends of the drum. Each of the rings is provided with a pair of angularly spaced flanges 24 and 25 extending outwardly from such rings. The flanges on each ring are arranged in opposed sets, each set mounting a respective one of four longitudinally disposed lifting bars 26 therebetween.

Four spaced apart, generally L-shaped support members or legs 28 are connected to the underside of the tank for supporting the tank in its horizontal disposition. The support members define a pair of longitudinally spaced upright plates 29 on opposite sides of the tank for purposes hereinafter more fully described.

Figure 2:
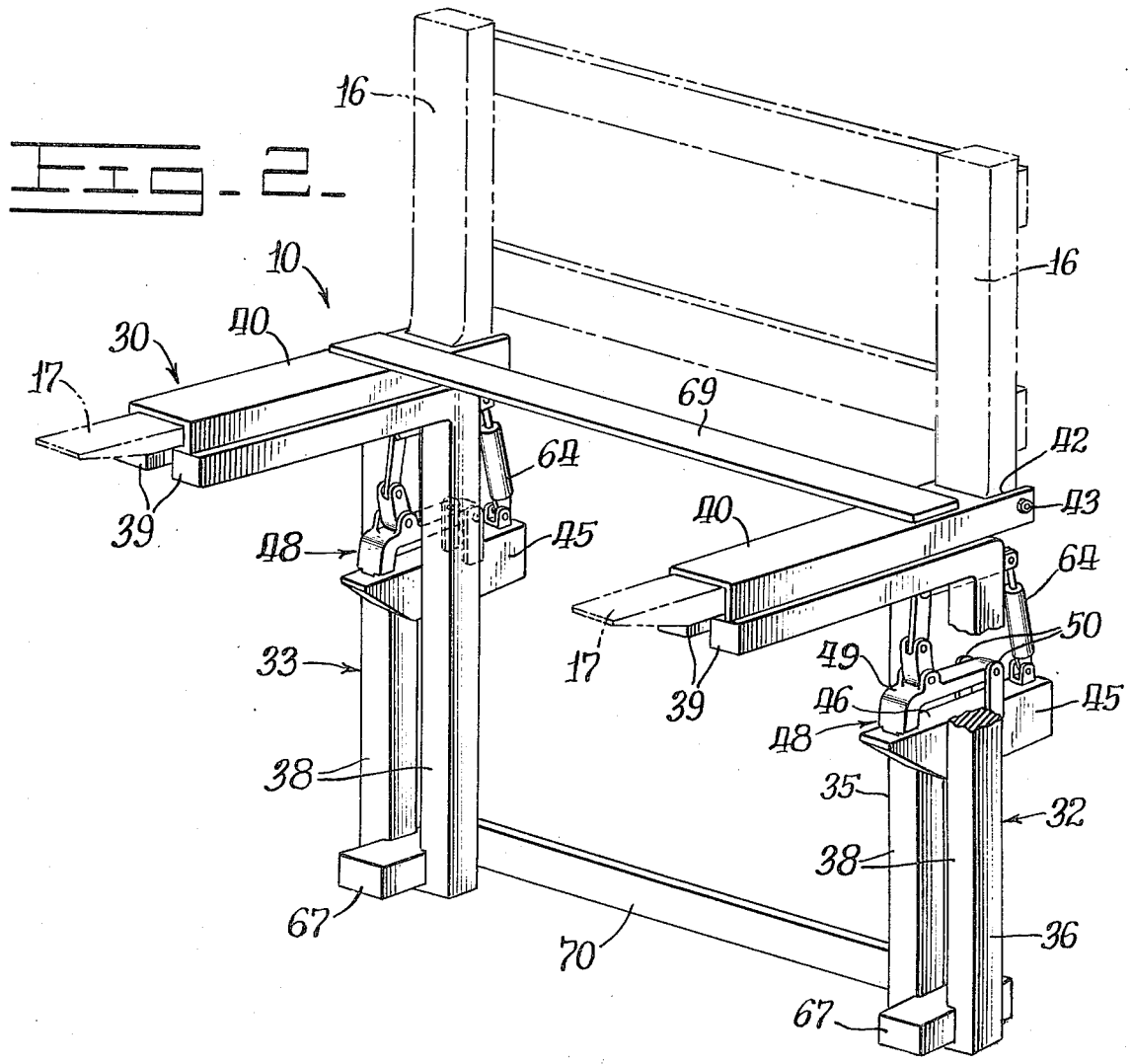
FIG. 2 is an enlarged isometric view of the container handling attachment and better illustrating the preferred method of its mounting on the lift mast of the lift truck.

Referring now more particularly to the container handling attachment 10, the present embodiment thereof includes a fabricated frame 30. As best shown in FIG. 2, the frame includes a pair of laterally spaced, left and righthand side frame assemblies 32 and 33, respectively. As such side frame assemblies are constructed identically, only the righthand side frame assembly 32, as viewed in FIG. 2, will be hereinafter described in detail with the numbers used in association therewith being repeated on the lefthand assembly 33 for depicting components thereof corresponding with those of the righthand assembly 32.

The righthand side frame assembly 32 includes a pair of opposing, laterally spaced, inverted L-shaped support members 35 and 36, each having an upright leg portion 38 and a forwardly extending arm portion 39. An elongated, rectangularly shaped sleeve 40 is disposed longitudinally along the top of the arm portions of each support member and is secured therebetween in any suitable manner, such as by welding. The sleeve is sized so as to closely, slidably receive a respective one of the forwardly extending forks 17 of the mast carriage 16 for pendantly supporting their respective side frame assemblies from the forks. The sleeve is provided with a rearwardly disposed cutout portion 42 so that its opposite sides extend a short distance beyond the mast carriage. An elongated bolt 43 is disposed through aligned apertures, not shown, provided through such sides behind the mast carriage for detachably securing the frame thereto.

The side frame assembly 32 is also provided with an elongated, fore and aft extending lifting lug 45 having an upper lifting surface 46. Such surface is received in underlying engagement with a respective one of the lifting bars 26, FIG. 3, of the tank 20. The lifting lug is secured between the upright leg portions 38 of the support members 35 and 36 at a predetermined vertical distance below the arm portions 39. This insures adequate clearance between the tank and the arm portions when engaging the lifting lugs under their respective lifting bars of the tank to prevent interference between the tank and such arm portions. The leg portions are also provided with a predetermined length so that the vertical distance between the upper lifting surface 46 of the lifting lug and the lower ends of the leg portions 38 is slightly less than the corresponding vertical height between the legs 28 and the lifting bar 26 of the tank. As a result, the lift truck operator merely has to position the lower end of the leg portions at ground level as he drives toward the tank to insure the proper positioning of the lifting lugs with respect to the lifting bars of the tank.

A latching mechanism 48 is provided for insuring the retention of the lifting bar 26 on the lifting lug 45. Such latching mechanism includes an elongated latch member 49 having one end pivotally mounted by a pair of brackets 50. Such brackets are secured on the opposite sides of the lifting lug 45 adjacent its rearward end. The opposite end of the latch member is provided with a downwardly extending hook portion 51.

As best shown in FIG. 5, the lower end of the hook portion 51 is provided with a downwardly projecting tongue 52. Such tongue is received into a mating aperture 54 provided in the upper lifting surface 46 of the lifting lug 45 when the latch member 49 is closed, as shown in FIG. 3. Thus, any horizontal loads exerted on the latch member by the lifting bar 26 of the tank is transmitted directly to the lifting lug 45 through the abutting engagement of the tongue 52 with the surfaces of the aperture 54. As a result, such loads are relieved from the brackets 50.

The latching mechanism 48 also includes an overcenter linkage mechanism 55 for moving the latch member 49 between its closed position of FIG. 3 and its open position, shown in FIG. 4. Such linkage mechanism includes a link 56 having one end pivotally connected to a bifurcation 57 provided on the latch member adjacent its end having the hook portion 51. The other end of the link is pivotally connected to a downwardly extending arm 59 of a bell crank 60. The apex of the bell crank is pivotally connected by a bracket 61 secured to the arm portions 39 of the support members 35 and 36. A rearwardly extending arm 62 of the bell crank is pivotally connected to the rod end of a hydraulic jack 64. The head end of such jack is pivotally connected by a bracket 65 to the rearward end of the lifting lug 45.

When the latch member 49 is closed, as shown in FIG. 3, the link 56 and the downwardly extending arm

59 of the bell crank 60 are disposed in an over-center relation so that any opening force exerted directly on the latch member tends to rotate the bell crank in a clockwise direction, as viewed in FIG. 3. A stop 66 is advantageously provided between the leg portions 38 in closely spaced underlying relation to the rearwardly extending arm 62 of the bell crank so as to limit such clockwise movement to prevent the inadvertent opening of the latch member by such opening force.

As shown in the drawings, the upper lifting surface 46 of the lifting lug 45 is substantially flat and horizontal. This provides an additional safety feature in that if the latch member 49 is inadvertently left open when attempting to raise the tank, the lifting bar 26 will slide off the lifting lug 45 due to rotation of the tank about its center of gravity, thus preventing the tank from being raised.

A forwardly extending bumber stop 67 is provided at the lower ends of the leg portions 38 to engage the upright plate 29 of the adjacent leg 28 of the tank 20. Such bumper stop prevents rotation of the tank about its longitudinal axis so as to keep its legs level when the tank is raised to alleviate any undesirable shifting of the tank during subsequent unloading.

As mentioned earlier, the lefthand side frame assembly 33 is constructed identically to the righthand side frame assembly 32, just described. Thus, the lefthand side frame assembly functions to engage its corresponding lifting bar 26 at the opposite end of the tank 20.

The two side frame assemblies 32 and 33 are rigidly tied together by a pair of transverse cross support bars 69 and 70, FIG. 2. Bar 69 is connected across the sleeve members 40, whereas bar 70 is disposed between the lower ends of the leg portions 38.

As illustrated schematically in FIG. 3, the jacks 64 of each side frame assembly are supplied by a common hydraulic circuit 71. Such circuit has a control valve 72 which is adapted to receive fluid pressure from a pump 73. The control valve is preferably located at the operator's station 13 of the lift truck 12, as indicated by reference numeral 72 in FIG. 1, so that the operator can selectively latch and unlatch the container handling attachment from the tank 20 without having to leave the truck.

In addition to enabling the lift truck to handle the tank 20, the container handling attachment 10 is also quickly and easily removed from the lift mast 14 by the mere removal of the two bolts 43 and the withdrawing of the forks 17 from the sleeve members 40 so as to permit the use of the truck for other useful purposes when desired.

As is readily apparent from the foregoing, the construction of the present container handling attachment 10 fully satisfies the objects of the present invention by effectively enabling a conventional lift truck to handle large horizontal drum-type shipping tanks. By the use of such attachment, the lift truck can efficiently retrieve such tanks from a storage area, transport the tanks to an appropriate shipping area and then load them onto a waiting transport vehicle, all without the assistance of any personnel other than the lift truck operator. The attachment is also provided with advantageous features which prevent the inadvertent dropping or loss of the tank during any of the preceding operations which greatly contributes to the safe handling of such tanks.

While the present invention has been described and shown with particular reference to the preferred embodiment thereof, it will be apparent that variations might be possible that would fall within the scope of the present invention, which is not intended to be limited except as defined in the following claims.

What is claimed is:

1. A container handling attachment, for a lift truck having a pair of forwardly extending, vertically movable lift forks, which attachment enables such truck to handle a relatively large, horizontally disposed cylindrical object having a pair of longitudinally spaced lifting bars disposed in offsetting relation to one side of the periphery of such object, said container handling attachment comprising:

a frame having a pair of laterally spaced side frame assemblies;

means for individually mounting each of said side frame members to respective ones of said lift forks of the truck;

a pair of lifting lugs, each carried on a respective one of said side frame members and positioned for lifting engagement with a respective one of said lifting bars of the object;

latching means mounted to said lifting lugs for selectively retaining said lifting bars on said lugs, said latching means being movable from an open, non-retaining position to a closed position in which said latching means is disposed in retaining engagement with said lifting lugs about said lifting bars so as to prevent the disengagement of said bars when the latching means is in its closed position;

actuator means;

over-center linkage means interconnected between said actuator means and said latching means for moving said latching means between said open and closed positions in response to said actuator means, said linkage means having a bell crank pivotally movable in one direction upon an opening response from said actuator means and in the opposite direction upon an opening force exerted thereon through said latching means; and stop means secured adjacent said bell crank for engagement therewith to limit the pivotal movement of said bell crank in said opposite direction so as to prevent said opening force from opening said latching means.

2. The attachment of claim 1 wherein said actuator means includes;

a hydraulic jack operatively connected to said bell crank;

a source of fluid pressure; and a control valve connected to said source of fluid pressure for selectively directing said fluid pressure to said jack, said control valve being disposed on said lift truck so as to permit an operator thereof to open and close said latching means therefrom.

3. The attachment of claim 2 wherein said means for selectively retaining said lifting bars upon said lugs further includes:

means for preventing said attachment from lifting said object when said latching means is in its open position.

4. The attachment of claim 3 wherein;

said pair of side frame assemblies each includes a pair of inverted L-shaped support members with each of said pair of support members being disposed in spaced opposing relation and each having an upright leg portion and a forwardly extending arm portion; and said mounting means includes a pair of elongated sleeves individually mounted atop respective ones of said arm portions of each pair of support members, said sleeve being sized so as to closely slidably receive one of said lift forks for pendantly supporting each pair of support members from a respective one of said forks.

5. The attachment of claim 4 including means for detachably mounting said sleeves on said lift forks.

6. The attachment of claim 5 wherein said leg portions are provided with a predetermined length and said pair of lifting lugs are individually secured between the corresponding leg portions of respective ones of said side frame assemblies at a predetermined elevational distance below said arm portions of the support members so as to provide adequate clearance to facilitate the engagement of said lifting lugs under their respective lifting bars of the object without interference between the object and such arms.

7. The attachment of claim 6 wherein the cylindrical object is provided with support means for supporting said object in its horizontal disposition, and said attachment further comprises:

a bumper stop connected to the leg portions of each side frame assembly, each bumper stop being positioned below its corresponding lifting lug for abutting engagement with said support means so as to prevent rotation of the object about its longitudinal axis when raised by the attachment.

8. The attachment of claim 7 wherein said leg portions have lower ends spaced a predetermined distance below said lifting lugs so that said lugs are at their proper height for lifting engagement with their respective lifting bars of the object when the lower ends of the leg portions are substantially level with said support means of the object.

9. The attachment of claim 1 wherein said latching means includes a pair of latch members pivotally mounted on a respective one of said lifting lugs, each of said latch members being provided with a downwardly extending hook portion having a downwardly projecting tongue extending therefrom; and wherein each of said lifting lugs is provided with a substantially flat, horizontal upper lifting surface thereon to prevent the raising of the object whenever the latching means is open, said lifting surface having a mating aperture for receiving the tongue of its corresponding latching member so that any horizontal load exerted on the latch member by the object can be transmitted directly into the lug through the abutting engagement of said tongue within said mating aperture.

10. The attachment of claim 9 wherein a pair of said bell cranks are provided, each being pivotally mounted to said side frame members above a respective one of said latch members, each bell crank having a first arm extending downwardly toward its respective latch member and a second arm extending rearwardly toward and pivotally connected to said actuator means; and wherein said linkage means includes a pair of links each pivotally interconnected between the first arm of the bell crank and its respective latch member.

* * * * *